US008157125B2

(12) United States Patent
Schiff

(10) Patent No.: US 8,157,125 B2
(45) Date of Patent: Apr. 17, 2012

(54) SYSTEMS AND METHODS FOR REMOVING MEDICATION FROM PACKAGING

(75) Inventor: David Schiff, Philadelphia, PA (US)

(73) Assignee: MTS Medication Technologies, Inc., St. Peterson, FL (US)

( * ) Notice: Subject to any disclaimer, the term of this patent is extended or adjusted under 35 U.S.C. 154(b) by 0 days.

(21) Appl. No.: 11/737,644

(22) Filed: Apr. 19, 2007

(65) Prior Publication Data

US 2008/0257904 A1 Oct. 23, 2008

(51) Int. Cl.
*B65H 5/00* (2006.01)

(52) U.S. Cl. ..... 221/74; 221/197; 221/287; 221/302; 221/71

(58) Field of Classification Search ..... 221/1–312 C
See application file for complete search history.

(56) References Cited

U.S. PATENT DOCUMENTS 5,630,347 A * 5/1997 Elvio ..... 83/210
6,024,247 A * 2/2000 Birr ..... 221/26
6,997,344 B2 * 2/2006 Brown et al. ..... 221/258
2004/0099676 A1 * 5/2004 Anderson et al. ..... 221/25
* cited by examiner

*Primary Examiner* — Michael K Collins
(74) *Attorney, Agent, or Firm* — Robert J. Depke; Rockey, Depke & Lyons, LLC

(57) ABSTRACT

Improved solid pharmaceutical dispensing systems and methods provide direct transfer of doses from bulk blister packaging material. In a preferred embodiment, the invention comprises a positioning mechanism that alters the spacing between portions of a de-blister apparatus. The de-blister apparatus comprises a de-blister roller, cylinder or elongated cylindrical toothed gear which pushes against a first side of packaging material to remove individual doses from a conventional blister package. The apparatus may operate under manual or automatic control and preferably includes adjustable or movable package holding rollers which are preferably aligned with portions of packaging material between the rows of blister cavities at a side of the packaging material opposite the side at which the roller or cylinder is located. The de-blister apparatus enables the rapid removal of solid pharmaceutical or nutraceutical products from blister cavities and provides a convenient mechanism for altering the device in order to accommodate different sizes of packaging material.

8 Claims, 7 Drawing Sheets

SYSTEMS AND METHODS FOR REMOVING MEDICATION FROM PACKAGING

BACKGROUND OF THE INVENTION

1. Field of the Invention

The present invention relates, in general, to the field of medication dispensing systems and methods. More specifically, the present invention is directed to systems and methods for rapidly removing solid pharmaceutical medications and nutraceuticals from blister packages.

2. Description of the Related Art

The present invention overcomes the shortcomings and the deficiencies of the prior art systems and methods for removing solid pharmaceuticals from blister packages and is directed to systems and methods which substantially increase the number of blister packages which may be emptied in a given amount of time.

Over the last few years in the field of drug therapy, there has been an increase in the number of treatments that utilize more then one pharmaceutical product to treat any particular ailment. Moreover, as the world population ages, more patients are taking a plurality of medications on a daily basis to treat multiple ailments or diseases. In response, various forms of packaging have been developed in order to organize the medications by time of day and/or day of the week in order to ensure that the proper doses of medication are taken at the correct time of day.

In most instances, an individual receives one or more prescriptions from a doctor, and a pharmacy provides a predetermined supply of each medication properly distributed amongst cavities of a single container, sometimes called a custom pharmaceutical package. Each cavity in the container or package is labeled for a different day or time of day to ensure that the patient takes the proper medication and dosage throughout the time period prescribed by the doctor. Thus, when an individual is required to take numerous pharmaceutical products throughout a given day the individual simply accesses the proper individual cavity to retrieve the correct dose of medication(s).

As an example of such a package, a container is divided in both the x and y direction into a plurality of individual cavities. The labels in the x direction are, for example, the days of the week: "Monday, Tuesday, Wednesday," etc. The labels in the y direction are, for example, "Morning, Afternoon, Evening, Bedtime," etc.

In order to assist pharmacies in filling these packages, automated systems have been developed that disperse individual doses from a bulk supply into respective containers.

However, a problem has arisen in countries such as the United Kingdom which require all medications to be sold and distributed in individual blister packages. As a result, it has not been possible to utilize such automatic packaging devices without first manually removing each medication from the blister pack to form a bulk supply. Such a shortcoming reduces the usefulness of the apparatus and detrimentally causes reduced sales of the devices in these regions. Accordingly, there remains a need in the field for improved pharmaceutical dispensing devices that directly transfer medication doses from a blister pack into a cavity of a custom pharmaceutical package in accordance with a particular patient's needs.

One prior solution is described in earlier filed published United States patent application number 2006/0277870 which is incorporated herein by reference. This application describes an earlier technique in which individual blister packages were emptied through the use of a plunger mechanism which mechanically pushed against the blister cavity to eject the solid pharmaceutical product. One shortcoming and deficiency of this prior approach is the limited throughput achieved by this mechanism. In this prior approach, the system operator was only able to eject the solid product or products from a single blister package cavity at any given time. Although this approach improved over the prior art, greater processing speeds are still desired. Accordingly, there remains a need for new and improved systems and methods which are able to achieve greater throughput by more quickly ejecting solid pharmaceutical and nutraceutical products from blister package cavities.

Other objects and advantages of the present invention will be apparent in light of the following Summary and detailed description of presently preferred embodiments.

SUMMARY OF THE INVENTION

The present invention is directed to systems and methods for rapidly ejecting solid pharmaceutical and nutraceutical products from a plurality of blister package cavities.

In accordance with a first preferred exemplary embodiment of the present invention, the medication dispensing system and method employs a de-blister apparatus which incorporates a mechanical structure for removing individual doses from a blister pack. The de-blister apparatus is preferably comprised of a de-blister roller, cylinder or elongated cylindrical toothed gear which pushes against a first side of packaging material to remove individual doses from a conventional blister package.

In a preferred exemplary embodiment, the invention comprises a positioning mechanism that alters the spacing between portions of the de-blister apparatus. The apparatus may operate under manual or automatic control and preferably includes adjustable or movable package holding rollers or gear members which are preferably aligned with portions of packaging material between the rows of blister cavities at a side of the packaging material opposite the side at which the roller or cylinder is located. The de-blister apparatus enables the rapid removal of solid pharmaceutical or nutraceutical products from blister cavities and provides a convenient mechanism for altering the device in order to accommodate different sizes of packaging material.

The de-blister roller, cylinder or elongated cylindrical toothed gear pushes against a first side of packaging material to remove individual doses from a conventional blister package. Preferably the de-blister roller, cylinder or elongated cylindrical toothed gear pushes against the actual blister members to force the solid pharmaceutical products or nutraceuticals out from the blister package cavities by pushing them through the blister package cavity sealing material. The adjustable or movable package holding rollers or gear members are preferably aligned with portions of packaging material between the rows of blister cavities at a side of the packaging material opposite the side at which the de-blister roller, cylinder or elongated cylindrical toothed gear is located. The adjustable or movable package holding rollers or gear members are provided for the purpose of securing and moving the package and ensuring that the de-blister roller, cylinder or elongated cylindrical toothed gear pushes against a first side of packaging material to remove individual doses from a conventional blister package.

A hand crank or motor is provided to drive the de-blister roller, cylinder or elongated cylindrical toothed gear and force the packaging material between the de-blister roller, cylinder or elongated cylindrical toothed gear and the adjustable or movable package holding rollers or gear members. In accordance with a preferred exemplary embodiment, the de-blister roller, cylinder or elongated cylindrical toothed gear preferably has teeth which engage with corresponding teeth of the adjustable or movable package holding rollers or gear members. Placement of the packaging material between these rotating bodies forces the packaging material between the structures thereby ejecting pills from the blister package cavities. A tray is preferably provided beneath the location at which the pills are ejected for conveniently receiving and temporarily storing the solid pharmaceutical or nutraceutical products that have been removed from the blister package cavities.

In a preferred embodiment of the invention, the lateral spacing between the adjustable or movable package holding rollers or gear members may be altered so that the solid pharmaceutical or nutraceutical de-blister mechanism will accommodate a variety of different blister packages wherein the spacing between the rows of blister package cavities is different. In one preferred embodiment of the present invention, a barrel cam is provided and rotation of the barrel cam alters the spacing between a plurality of fingers, each of which are in contact with one of the adjustable or movable package holding rollers or gear members. The barrel cam may be conveniently rotated manually with a knob or alternatively, a motor may be provided. Adjusting the spacing between a plurality of fingers with the barrel cam, each of which are in contact with one of the adjustable or movable package holding rollers or gear members thereby also adjusts the spacing between the adjustable or movable package holding rollers or gear members.

Locating the adjustable or movable package holding rollers or gear members in the rows between the blister package cavities ensures that the package material is secured between the de-blister roller, cylinder or elongated cylindrical toothed gear and the adjustable or movable package holding rollers or gear members while also enabling these solid pharmaceuticals or nutraceuticals to be conveniently ejected through the sealing portion of the blister package cavity.

In an alternate embodiment, a plate cam may be utilized for the same purpose of altering the lateral spacing between a plurality of fingers, each of which are in contact with one of the adjustable or movable package holding rollers or gear members thereby also adjusting the spacing between the adjustable or movable package holding rollers or gear members.

DETAILED DESCRIPTION OF THE PRESENTLY PREFERRED EMBODIMENTS

Figure 1:
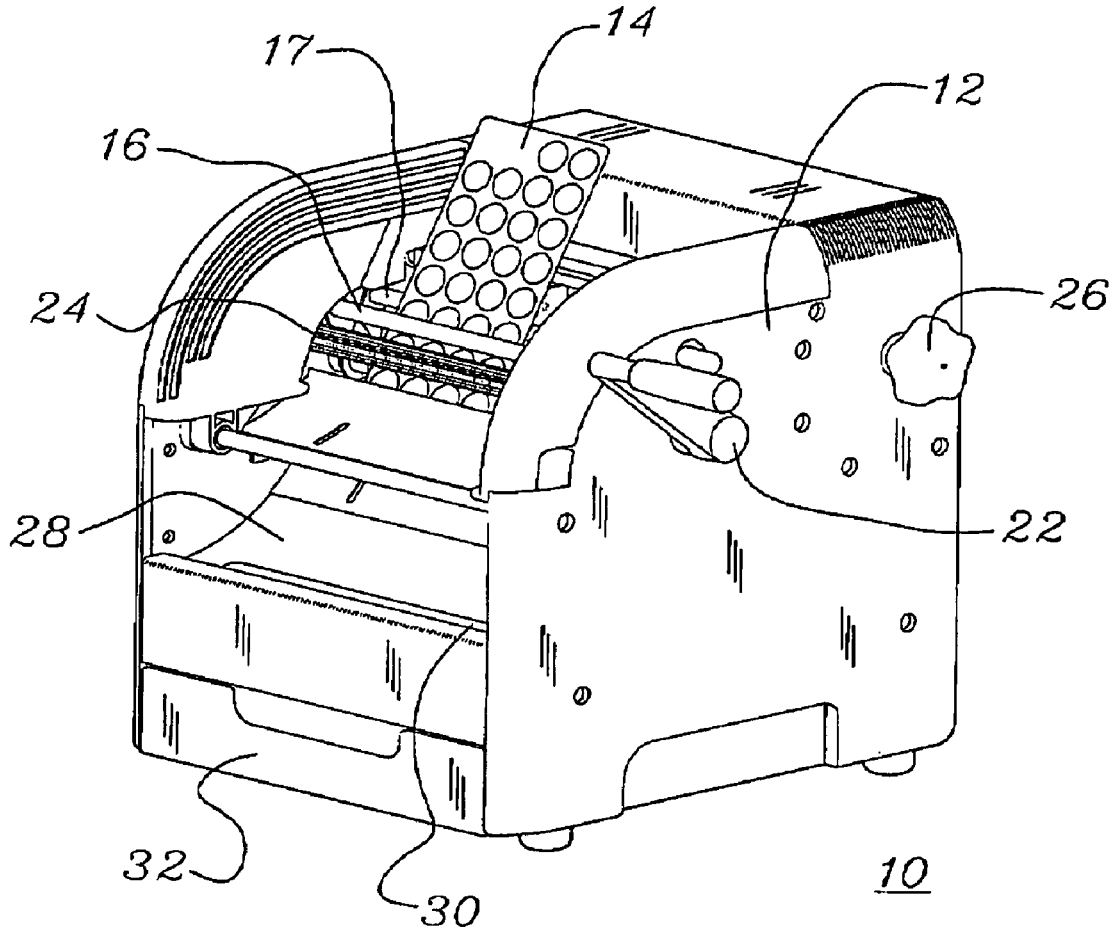
FIG. 1 illustrates a first exemplary embodiment for the blister package product ejection mechanism of the present invention.

FIG. 1 illustrates a first preferred exemplary embodiment of the present invention which is shown generally at 10. In accordance with the first preferred exemplary embodiment, a housing 12 is provided for securing the mechanical structures utilized in the implementation of the exemplary embodiment. As shown in the illustration of FIG. 1, a blister package 14 has a plurality of package cavities arranged in rows and columns. Lateral structural supports 16, 17, provide a space between which the product package cavity is fed. Lateral structural supports 16, 17 may also be embodied as rollers for conveniently passing the package 14 with less resistance.

Hand crank 22 preferably rotates the de-blister roller, cylinder or elongated cylindrical toothed gear 24 which preferably has teeth which engage with corresponding teeth of adjustable or movable package holding rollers or gear members which are not seen in this illustration and which are described later. A knob 26 is used to alter the spacing between the adjustable or movable package holding rollers or gear members as described in more detail below. The rotation of the knob 26 advantageously places the adjustable or movable package holding rollers or gear members preferably at locations corresponding to the spaces in between the vertical columns of blister package cavities of package 14.

The de-blister roller, cylinder or elongated cylindrical toothed gear 24 pushes against the blister package cavities of the package 14 thereby ejecting solid pharmaceutical products or nutraceuticals from the cavities. The solid pharmaceutical products or nutraceuticals drop away from the packaging and fall down slide 28 through opening 30 into tray 32 which conveniently catches and temporarily stores these solid pharmaceutical products and nutraceuticals which are ejected from the package 14.

Figure 2:
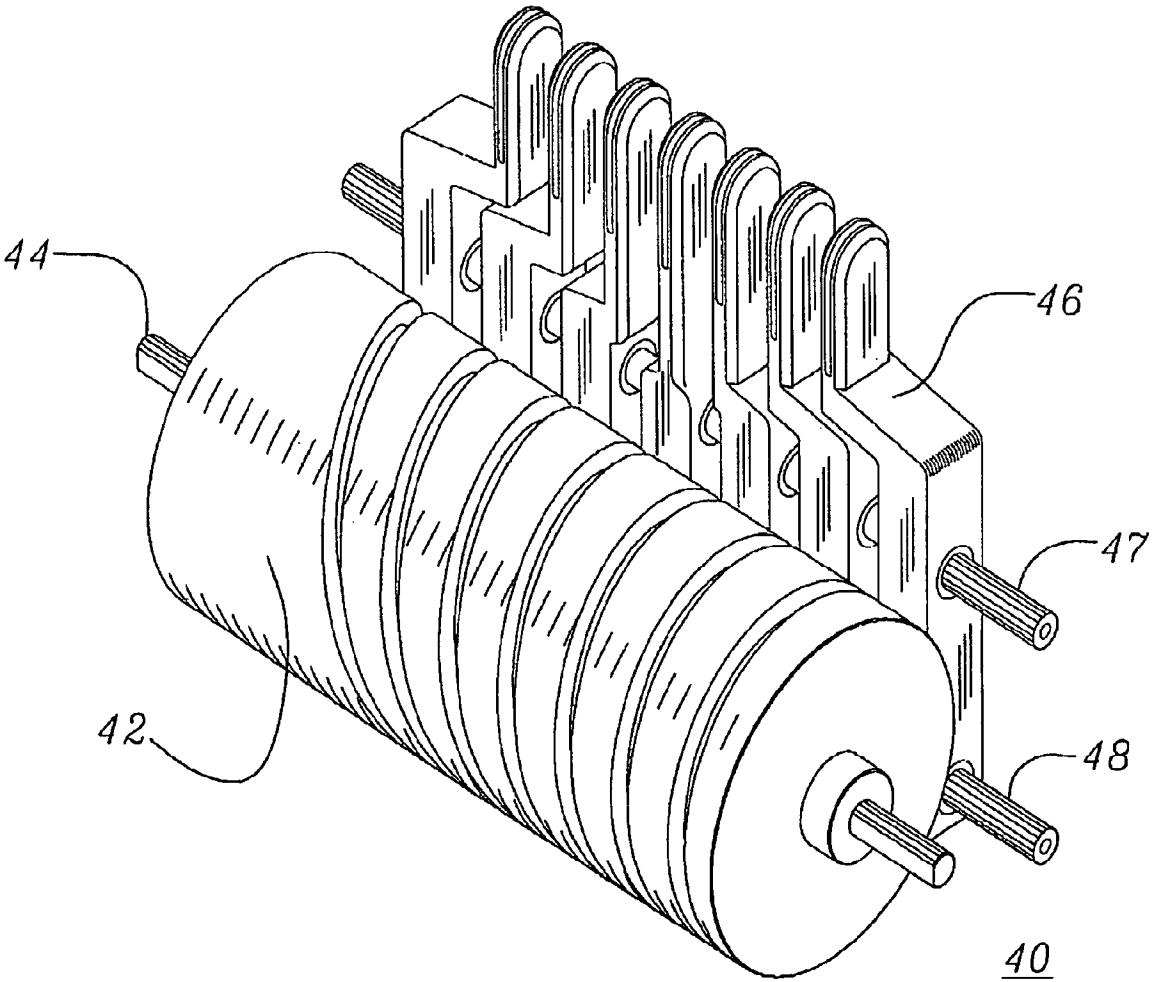
FIG. 2 illustrates the interaction between the barrel cam and the adjusting fingers in accordance with a preferred exemplary embodiment of the present invention.

FIG. 2 illustrates a first preferred exemplary embodiment of the internal structures which are used for altering the spacing between the adjustable or movable package holding rollers or gear members as described in more detail below. This structure is generally shown at 40. As shown in the illustration of FIG. 2, a barrel cam 42 is secured to a rotating axle that is rotated by the knob 26 described above. Lateral supports 47, 48 secure a plurality of fingers 46 that are used in adjusting the lateral position of the adjustable or movable package holding rollers or gear members described below. The illustration of FIG. 2 shows the fingers 46 in a spaced apart arrangement. Those skilled in the art will appreciate that the rotation of the barrel cam 42 causes changes in the lateral spacing of fingers 46 as a result of interaction between at least one tooth or projection that is secured to each finger 46 which engages the corresponding slot 43 on the barrel cam 42.

Figure 3:
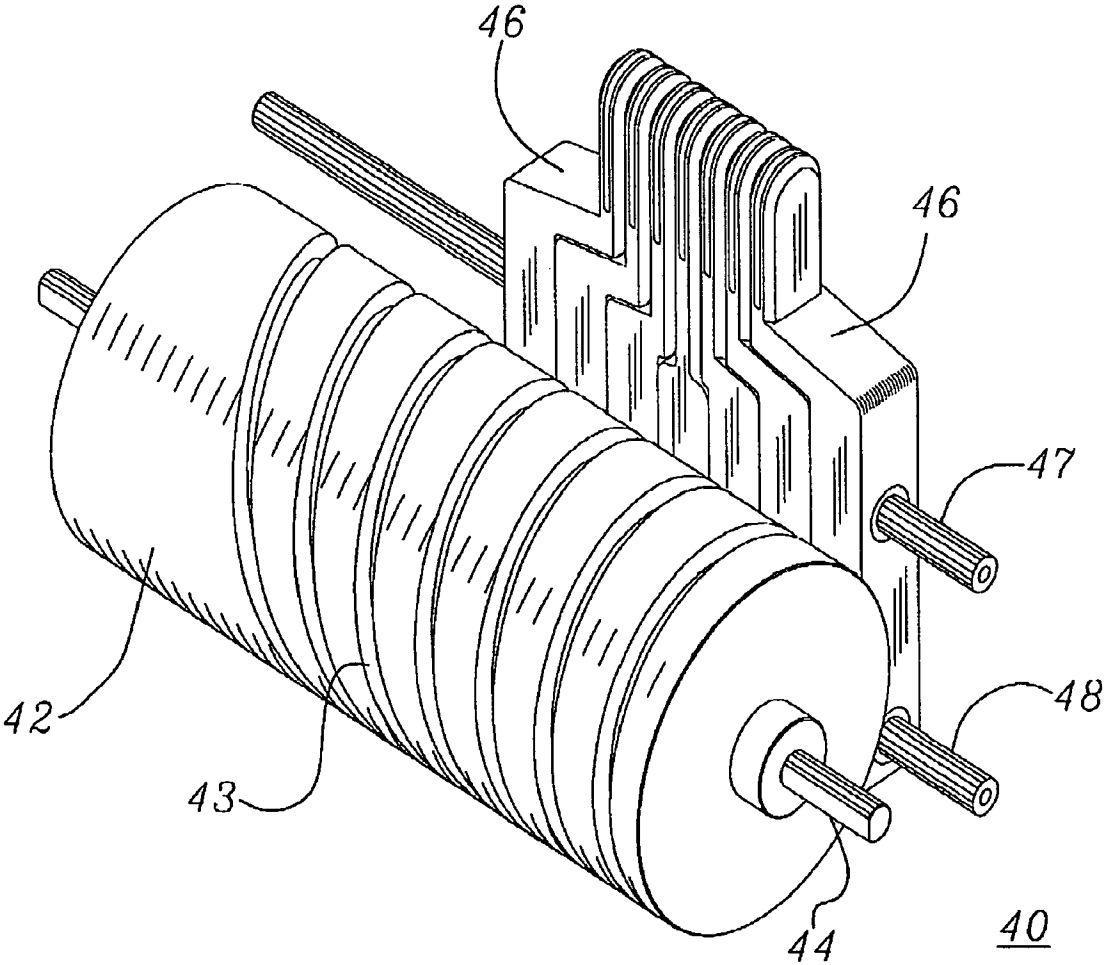
FIG. 3 illustrates the interaction between the barrel cam and the adjusting fingers in accordance with a preferred exemplary embodiment of the present invention.
Figure 4:
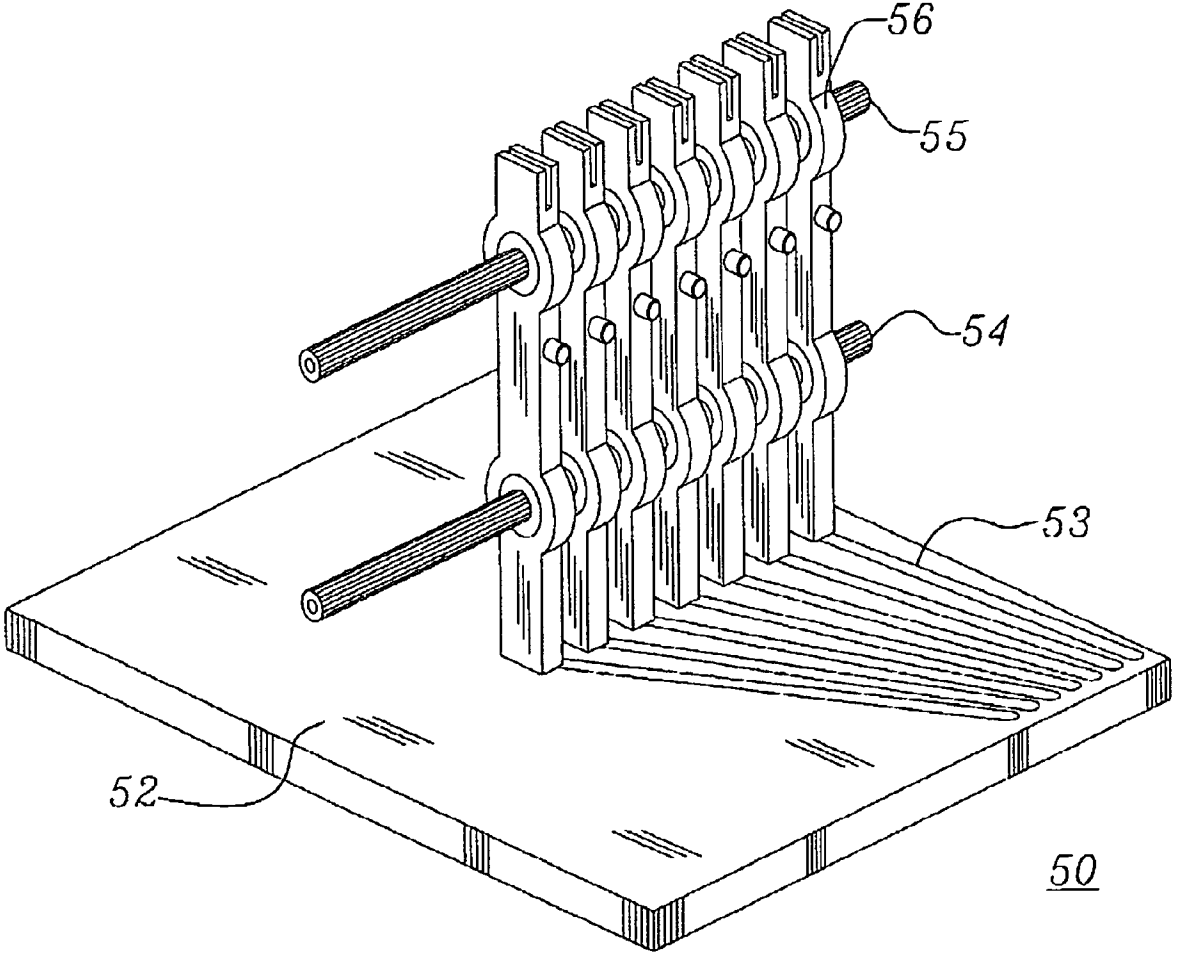
FIG. 4 illustrates the interaction between a plate cam and the adjusting fingers in accordance with a preferred exemplary embodiment of the present invention.
Figure 5:
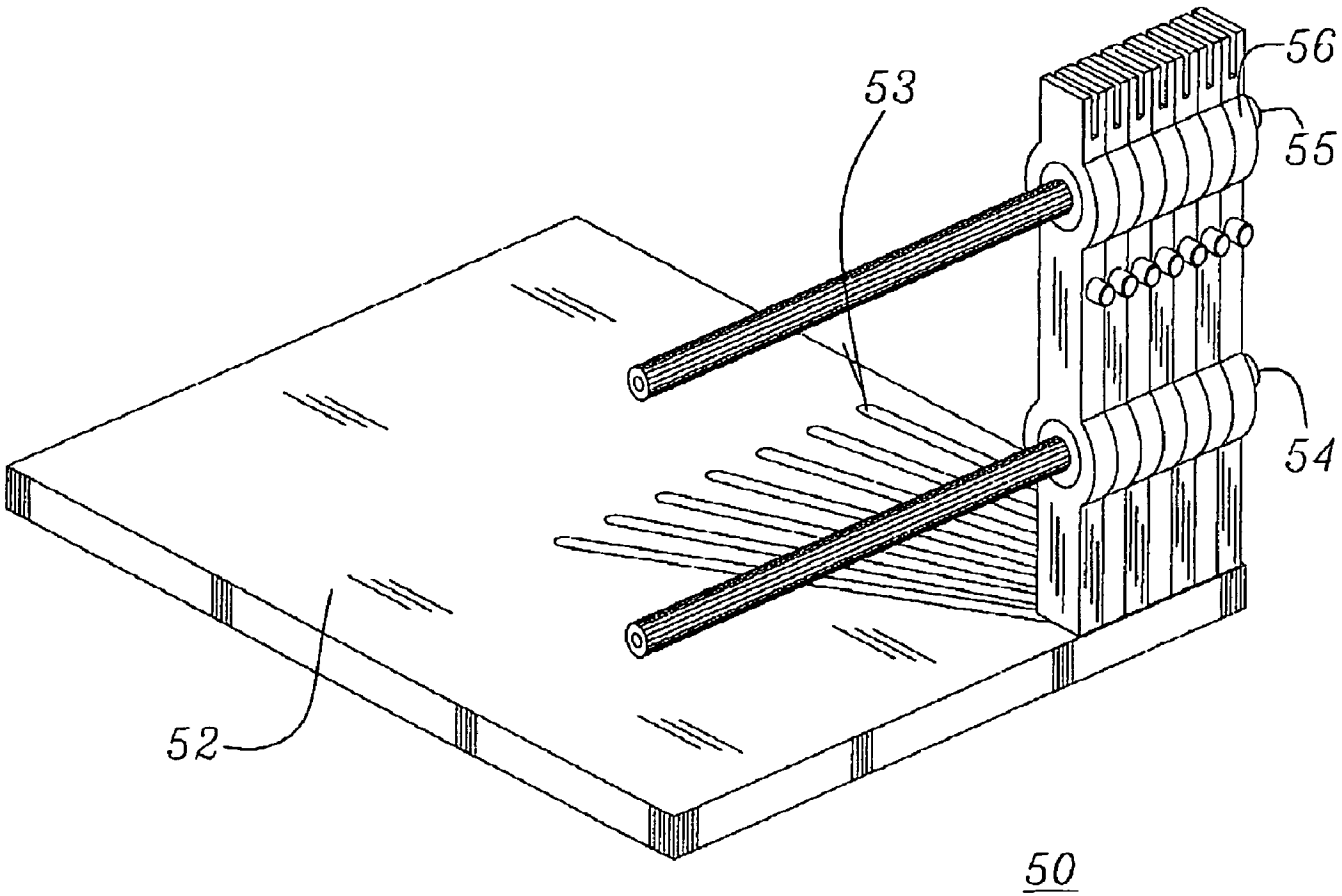
FIG. 5 illustrates the interaction between the barrel cam and the adjusting fingers in accordance with a preferred exemplary embodiment of the present invention.

The illustration of FIG. 3 shows the fingers 46 where they have been moved together by the rotation of the barrel cam via the interaction with a slot in the barrel cam 43 and a tooth or protruding member of the fingers 46. FIG. 4 illustrates an alternate preferred exemplary embodiment of the present invention, wherein an alternate cam member is utilized as shown generally at 50. In this alternate preferred exemplary embodiment, a plate cam 52 has a plurality of slots 53 which engage with the base of fingers 56 movably secured to lateral supports 54, 55. The increasing separation between the slots 53 enables motion of the plate cam 52 to alter the spacing between fingers 56. The illustration of FIG. 4 shows the fingers 56 in a spaced apart relationship. The illustration of FIG. 5 shows the fingers 56 of this alternate exemplary embodiment wherein the fingers are moved together as a result of the relative displacement between the fingers 56 and the plate cam 52.

Figure 6:
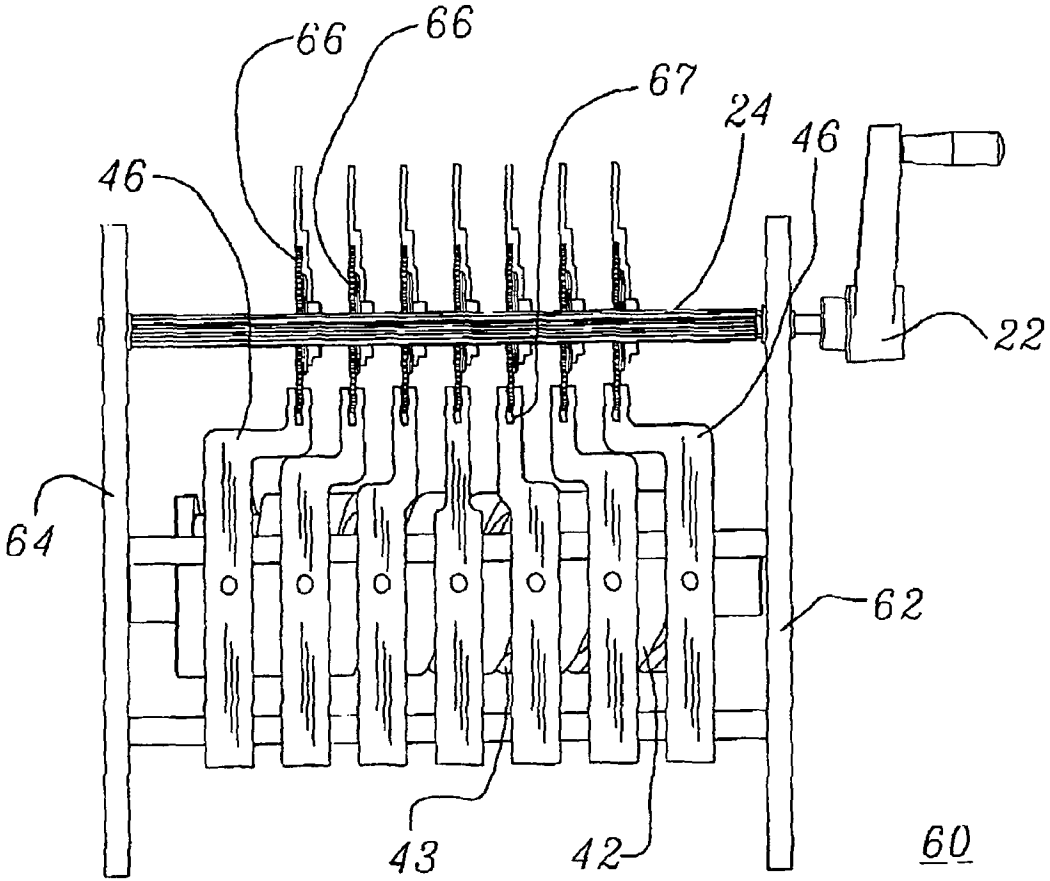
FIG. 6 illustrates the interaction between the adjusting fingers and the adjustable or movable package holding rollers or gear members.

FIG. 6 is a cutaway view which illustrates the interaction between the de-blister roller, cylinder or elongated cylindrical toothed gear 24, and the adjustable or movable package holding rollers or gear members 66. The illustration of FIG. 6, only shows 2 of the adjustable or movable package holding rollers or gear members 66. Those skilled in the art will appreciate that it is preferred to have at least one adjustable or movable package holding rollers or gear members 66 between each vertical column of the blister package cavities and it is also preferred to have one on each side of the edge columns. This arrangement insures that solid products can be ejected by the de-blister roller, cylinder or elongated cylindrical toothed gear 24 pushing against the blister package cavities and thereby pushing a solid product through the sealing portion of the blister pack cavity.

FIG. 6 illustrates the rotatable handcrank 22 which may be alternately replaced with a motor drive for rotating the de-blister roller, cylinder or elongated cylindrical toothed gear 24. The de-blister roller, cylinder or elongated cylindrical toothed gear 24 preferably has teeth which engage corresponding teeth of the adjustable or movable package holding rollers or gear members 66. The teeth of each of these members engage the package and the rotation of either member causes the rotation of the other and movement of the package therebetween. The de-blister roller, cylinder or elongated cylindrical toothed gear 24 pushes against the blister package cavities as the product package moves between the de-blister roller, cylinder or elongated cylindrical toothed gear 24 and the adjustable or movable package holding rollers or gear members 66 thereby forcing solid products from the package cavities.

FIG. 6 also illustrates the relationship between the adjustable fingers 46 which are moved laterally via interaction with a pin or projection 61 and the slot 43 of barrel cam 42. The lateral displacement of the fingers 46 which engage with the adjustable or movable package holding rollers or gear members 66 causes these members to similarly alter the spacing corresponding to the spacing between the fingers 46. It should be recognized that each finger 46 has a corresponding adjustable or movable package holding roller or gear member 66 although only 2 are shown in this illustration. Those skilled in the art will appreciate that the adjustable or movable package holding rollers or gear members 66 may be replaced with fixed package holding rollers or gear members located on an axle if it is desired to eliminate the need for the barrel cam or plate cam. In such an embodiment, the axle is simply removably mounted in the housing and a fixed spacing of each package holding roller or gear member on the axle corresponds with the package that is to be emptied. A plurality of axles Meeker provided each having a different fixed spacing between the package holding rollers or gear members on the axle. Each of the rollers and gear members may be formed from machined metal such as aluminum, rubber or hard plastic.

Figure 7:
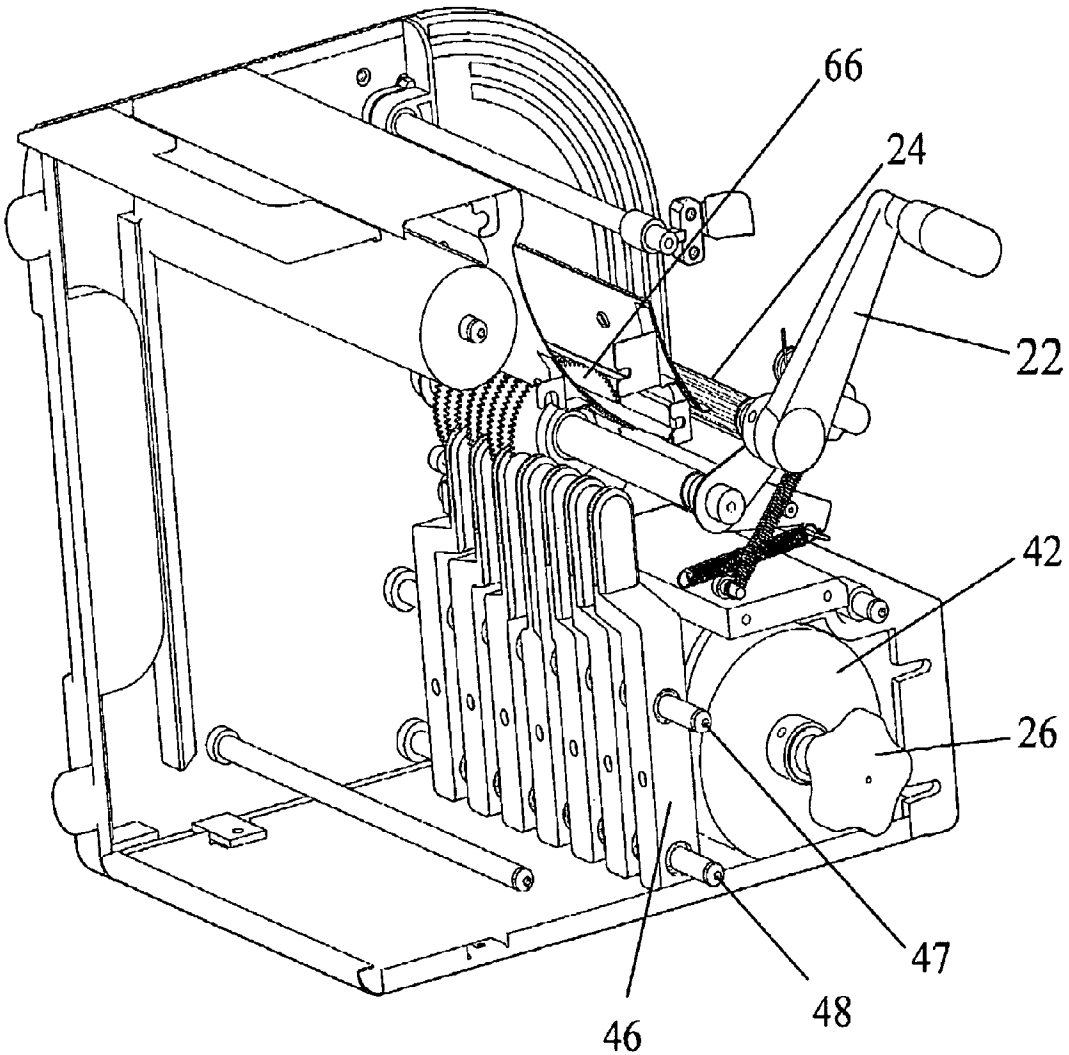
FIG. 7 is a cutaway illustration of a preferred exemplary embodiment of the present invention.

FIG. 7 is a cutaway illustration of the preferred embodiment of the mechanism described in FIG. 1. As shown in this illustration, handcrank 22 rotates the de-blister roller, cylinder or elongated cylindrical toothed gear 24 which preferably engages adjustable or movable package holding rollers or gear members 66. Knob 26 rotates barrel cam 42 to laterally displace fingers 46 secured to lateral supports 47, 48. The displacement of fingers 46 which engage with the adjustable or movable package holding rollers or gear members 66 to laterally displace these members.

Those skilled in the art will appreciate that the handcrank or motor that drives the de-blister roller, cylinder or elongated cylindrical toothed gear 24 may alternatively be used to rotate fixed package holding rollers or gear members in the embodiment described above wherein adjustable or movable package holding rollers or gear members 66 are replaced so that no barrel cam is needed. This alternate embodiment simply changes the location of the rotation driving force.

The invention claimed is:

1. A system for ejecting solid products contained within a blister package comprising:

a first rotating de-blister member secured to a housing;

a plurality of spaced apart package holding rollers or gear members rotatably secured adjacent to the first rotating de-blister member on an axial support, and wherein a blister package is secured between the first rotating de-blister member and the plurality of spaced apart package holding members and further wherein the plurality of spaced apart package holding members are laterally displaceable across the axial support while the axial support is secured to the housing, such that a distance between adjacent ones of the package holding members may be altered to correspond with the spacing between rows of blister cavities of the blister package that is to be emptied, the package holding rollers or gear members each having a corresponding lateral displacement arm that is in contact with its corresponding roller or gear member and the lateral displacement arms being mechanically connected to one another so that adjacent ones of the lateral displacement arms move simultaneously together or apart in order to laterally displace the package holding rollers or gear members across the axial support.

2. The system for ejecting solid products contained within a blister package of claim 1, wherein first rotating de-blister member is an elongated toothed gear.

3. The system for ejecting solid products contained within a blister package of claim 1, wherein movement of a cam member laterally displaces the plurality of spaced apart package holding members.

4. The system for ejecting solid products contained within a blister package of claim 1, further comprising a hand crank secured to the first rotating de-blister member.

5. A method for ejecting solid products contained within a blister package comprising:

providing a rotating de-blister member secured to a housing and a plurality of spaced apart package holding members rotatably secured adjacent to the first rotating de-blister member, the plurality of spaced apart package holding members being affixed to an axial support, moving a blister package between the first rotating de-blister member and the plurality of spaced apart package holding members thereby ejecting solid products contained within the blister package; and laterally displacing the plurality of spaced apart package holding members across the axial support while the axial support is secured to the housing such that a distance between adjacent ones of the package holding members is altered to correspond with a spacing between rows of blister cavities of a blister package that is to be emptied, the package holding members each having a corresponding lateral displacement arm that is in contact with its corresponding package holding member and the lateral displacement arms being mechanically connected to one another so that adjacent ones of the lateral displacement arms move simultaneously together or apart in order to laterally displace the package holding members across the axial support.

6. The method for ejecting solid products contained within a blister package of claim 5, wherein first rotating de-blister member is an elongated toothed gear.

7. The method for ejecting solid products contained within a blister package of claim 5, wherein movement of a cam member laterally displaces the plurality of spaced apart package holding members.

8. The method for ejecting solid products contained within a blister package of claim 5, further comprising rotating a hand crank secured to the first rotating de-blister member to thereby move the blister package between the rotating de-blister member and the plurality of spaced apart package holding members.

* * * * *